US006935870B2

(12) United States Patent
Kato et al.

(10) Patent No.: US 6,935,870 B2
(45) Date of Patent: Aug. 30, 2005

(54) CONNECTOR HAVING SIGNAL CONTACTS AND GROUND CONTACTS IN A SPECIFIC ARRANGEMENT

(75) Inventors: Nobukazu Kato, Fussa (JP); Koji Hayashi, Tachikawa (JP); Kazushi Kamata, Hirosaki (JP); Michitaka Ono, Hamura (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/090,956

(22) Filed: Mar. 5, 2002

(65) Prior Publication Data

US 2002/0123254 A1 Sep. 5, 2002

(30) Foreign Application Priority Data

Mar. 5, 2001 (JP) ..... 2001-060862
Mar. 9, 2001 (JP) ..... 2001-067706

(51) Int. Cl.[7] ..... H01R 12/00
(52) U.S. Cl. ..... 439/108; 439/607; 439/941
(58) Field of Search ..... 439/101, 108, 439/607, 608, 610, 660, 685, 941

(56) References Cited

U.S. PATENT DOCUMENTS 5,876,248 A * 3/1999 Brunker et al. ..... 439/608
5,895,276 A * 4/1999 Rothenberger ..... 439/67
6,280,209 B1 * 8/2001 Bassler et al. ..... 439/101
6,350,134 B1 * 2/2002 Fogg et al. ..... 439/941

FOREIGN PATENT DOCUMENTS

| | | |
|---|---|---|
| EP | 0486298 A1 * | 5/1992 |
| EP | 0 793 297 | 9/1999 |
| JP | 3-110772 | 11/1991 |
| JP | 04-269479 | 9/1992 |
| JP | 06-111888 | 4/1994 |
| JP | 09-245900 | 9/1997 |
| JP | 11-250996 | 9/1999 |
| JP | 11-251005 | 9/1999 |
| JP | 2001-345151 | 12/2001 |
| WO | WO 01/06602 | 1/2001 |

OTHER PUBLICATIONS

NIKKEI ELECTRONICS, IEE 1394 publication , No. 748, Jul. 26, 1999 (with English Abstract).

* cited by examiner

*Primary Examiner*—Renee Luebke
(74) *Attorney, Agent, or Firm*—Michael Best & Friedrich LLP

(57) ABSTRACT

A connector comprises a plurality of contact arrays parallel to one another. Each of the contact arrays includes two signal contacts (S) adjacent to each other and a ground contact (G) aligned with the signal contacts. In each contact array, the ground contact is located at a position corresponding to an intermediate position between two signal contacts in a next contact array.

9 Claims, 18 Drawing Sheets

CONNECTOR HAVING SIGNAL CONTACTS AND GROUND CONTACTS IN A SPECIFIC ARRANGEMENT

BACKGROUND OF THE INVENTION

This invention relates to a connector comprising a plurality of contact arrays and, in particular, to a connector suitable for high-speed differential signal transmission.

At first, high-speed differential signal transmission will be described. The high-speed differential signal transmission has two types of transmission modes, i.e., an unbalanced (single-end) type and a balanced (differential) type. The single-end type is a mode in which a high level and a low level of a digital signal are distinguished by the potential difference between a ground line and a signal line, and is generally used so far. On the other hand, the differential type is a mode in which two signal lines (+, −) are used and the high level and the low level are distinguished by the potential difference between the two signal lines. In the differential type, two signals on the two signal lines are equal in voltage level to each other and different in phase by 180° from each other. As compared with the single-end type, the differential type assures reliable transmission because noise produced in the two signal lines is canceled at the receiver input.

Besides, there is another transmission mode according to TMDS (Transition Minimized Differential Signaling). The TMDS is a standard for exchange of image data between a PC main body and a display monitor, and is a mode in which data transmission is performed by the use of two signal lines (+, −) and a single ground line.

In an existing connector comprising signal contacts and ground contacts, use is made of a structure in which the signal contacts and the ground contacts are faced to each other in a grid-like pattern or a structure in which the ground contacts are partially skipped. In the former structure, the number of contacts is increased so that miniaturization of the connector is difficult. In the latter structure, the high-frequency characteristics of the connector are considerably degraded.

At present, transmission of high-speed differential signals is required in a growing number of software applications. Under the circumstances, there is a demand for a connector having a compact size, a low price, and excellent high-frequency characteristics.

SUMMARY OF THE INVENTION

It is therefore an object of this invention to provide a connector which is compact in size, low in price, and excellent in high-frequency characteristics.

Other objects of the present invention will become clear as the description proceeds.

According to one aspect of this invention, there is provided a connector comprising a plurality of contact arrays parallel to one another, each of the contact arrays including two signal contacts adjacent to each other and a ground contact aligned with the signal contacts, the ground contact in each contact array being disposed at a position corresponding to an intermediate position between two signal contacts adjacent to each other in a next contact array.

According to another aspect of this invention, there is provided a connector comprising first and second contact arrays parallel to each other and a third contact array between the first and the second contact arrays, each of the first and the second contact arrays including a plurality of signal contacts, the third contact array including a plurality of ground contacts, each of the ground contacts being disposed at a position corresponding to an intermediate position between every adjacent ones of the signal contacts in each of the first and the second contact arrays.

According to still another aspect of this invention, there is provided a connector for high-speed differential signal transmission, the connector comprising a plurality of + signal contacts, a plurality of − signal contacts, and a plurality of ground contacts, the contacts being arranged in a manner such that a set of each single one of the + signal contacts, each single one of the − signal contacts, and each single one of the ground contacts are located at three apexes of an isosceles triangle, respectively.

DESCRIPTION OF THE PREFERRED EMBODIMENTS

At first referring to FIGS. 1A and 1B through FIGS. 3A to 3C, description will be made of a connector according to a first embodiment of this invention.

The connector illustrated in the figures is a receptacle connector 1. As illustrated in FIGS. 1B and 2A to 2D, the receptacle connector 1 comprises a plurality of signal contacts S, a plurality of ground contacts G, a plurality of ordinary (low-speed) contacts D, and an insulator 2 holding the signal contacts S, the ground contacts G, and the ordinary contacts D, and a receptacle shell 3 surrounding all of the above-mentioned components. Each pair of the signal contacts S adjacent to each other includes a + signal contact and a − signal contact.

Figure 1A:
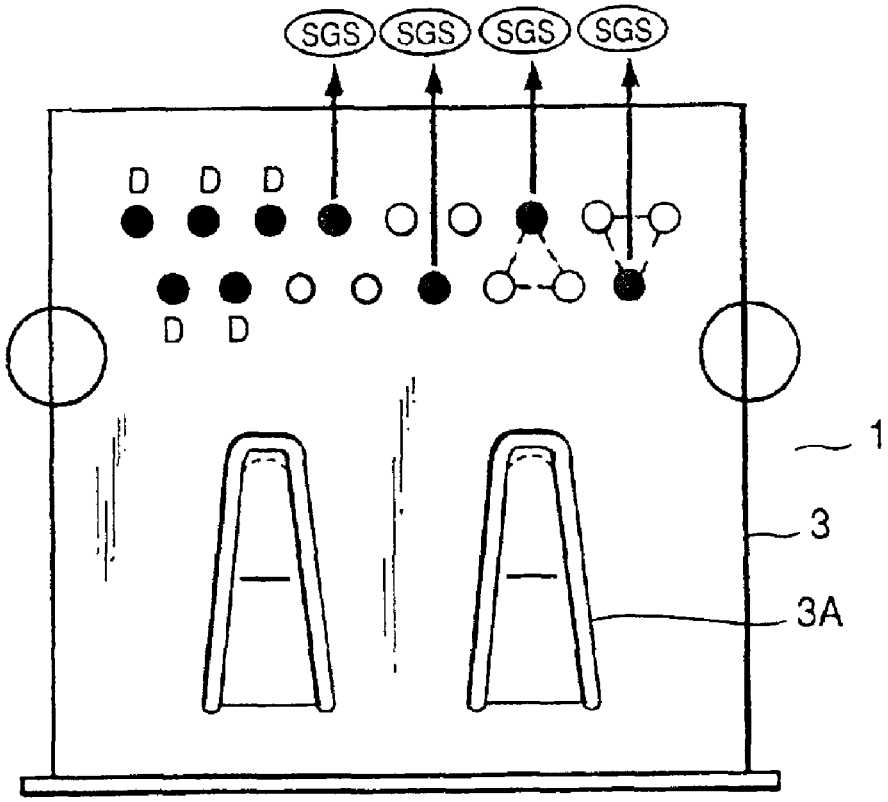
FIG. 1A is a schematic plan view of a receptacle connector according to a first embodiment of this invention.
Figure 1B:
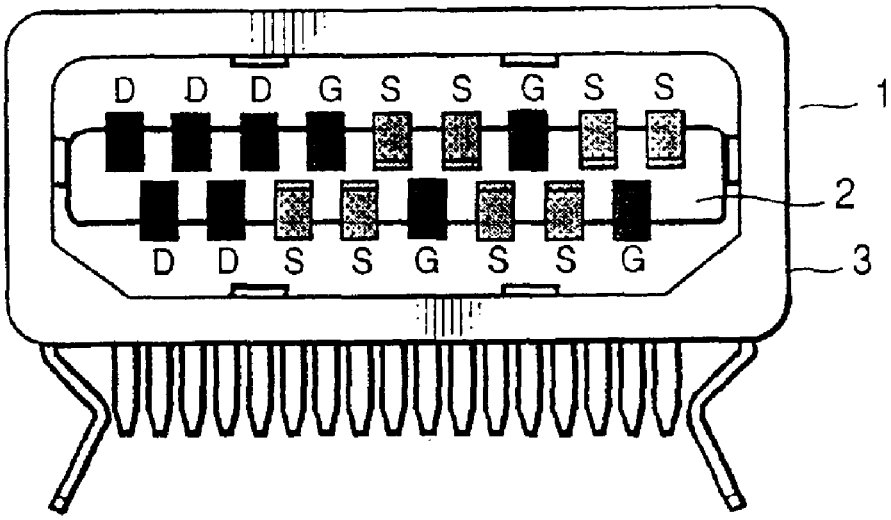
FIG. 1B is a schematic front view of the receptacle connector of FIG. 1A.
Figure 2A:
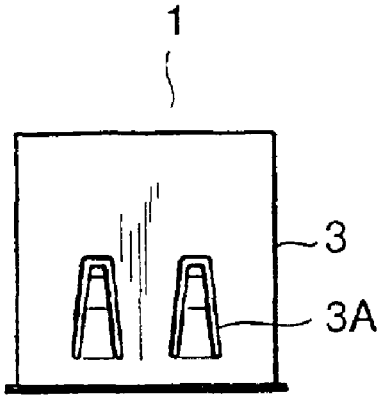
FIG. 2A is a plan view of the receptacle connector illustrated in FIGS. 1A and 1B.
Figure 2B:
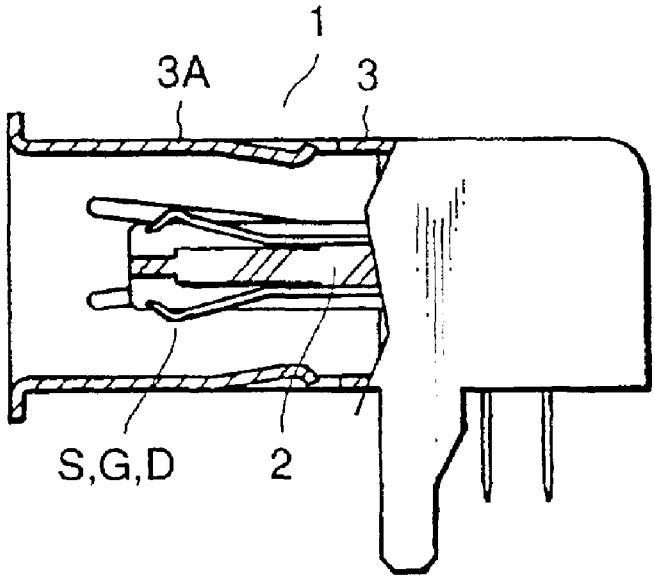
FIG. 2B is a partially-sectional side view of the receptacle connector of FIG. 2A.
Figure 2C:
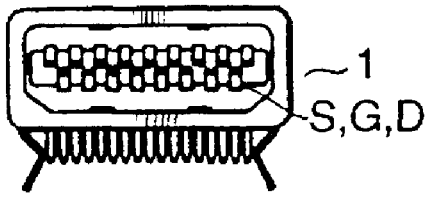
FIG. 2C is a front view of the receptacle connector of FIG. 2A.
Figure 2D:
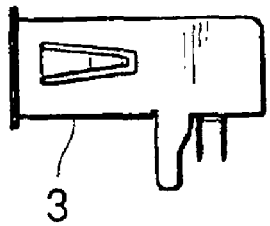
FIG. 2D is a side view of the receptacle connector of 2A.

As illustrated in FIG. 1B, the contacts of the above-mentioned three types (S, G, and D) are disposed in a specific arrangement. In an upper array, the contacts are arranged in the order of S, S, G, S, S, G, D, D, D from the right side. In a lower array, the contacts are arranged in the order of G, S, S, G, S, S, D, D from the right side. The signal contacts S, S adjacent to each other in the upper array and the ground contact G in the lower array are located at three apexes of an isosceles triangle. Likewise, the ground contact G in the upper array and the signal contacts S, S adjacent to each other in the lower array are located at three apexes of an isosceles triangle.

The receptacle shell 3 has an upper surface provided with a pair of springs 3A. The springs 3A are adapted to be engaged with a plug connector 6 illustrated in FIGS. 3A to 3C.

Figure 3A:
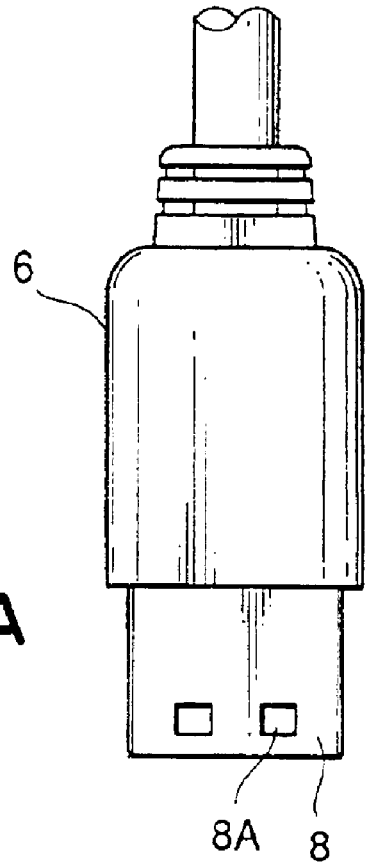
FIG. 3A is a plan view of a plug connector adapted to be connected to the receptacle connector illustrated in FIGS. 2A to 2D.
Figure 3C:
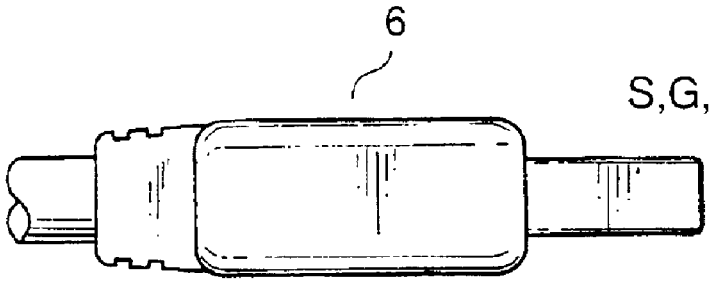
FIG. 3C is a side view of the plug connector of FIG. 3A.
Figure 3B:
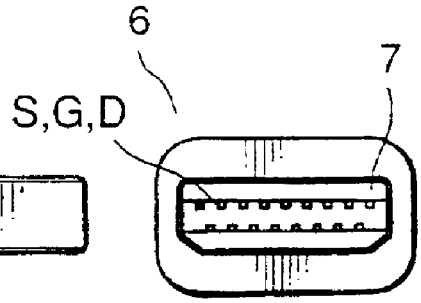
FIG. 3B is a front view of the plug connector of FIG. 3A.

Referring to FIGS. 3A to 3C, the plug connector 6 comprises a plurality of signal contacts S, a plurality of ground contacts G, a plurality of ordinary contacts D, an insulator 7 holding the signal contacts S, the ground contacts G, and the ordinary contacts D, and a plug shell 8 surrounding all of the above-mentioned components.

The plug shell 8 has an upper surface provided with a pair of holes 8A. The holes 8A are adapted to be engaged with the springs 3A of the receptacle connector 1, respectively.

Next referring to FIGS. 4 through 6A to 6C, description will be made of a connector according to a second embodiment of this invention.

The connector illustrated in the figures is a receptacle connector 11. As illustrated in FIGS. 4 and 5A to 5D, the receptacle connector 11 comprises a plurality of signal contacts S, a plurality of ground contacts G, a plurality of ordinary contacts D, an insulator 12 holding the signal contacts S, the ground contacts G, and the ordinary contacts D, and a receptacle shell 13 surrounding all of the above-mentioned components.

Figure 4:
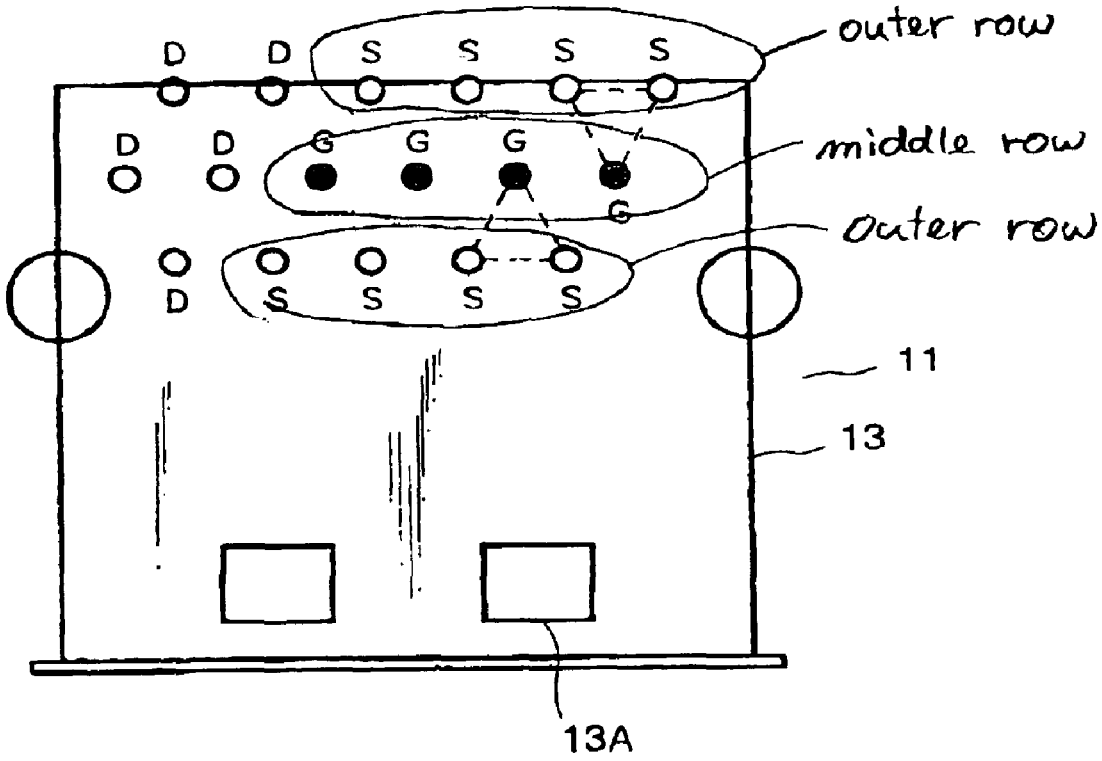
FIG. 4 is a schematic plan view of a receptacle connector according to a second embodiment of this invention.

Referring to FIG. 4, the contacts of the above-mentioned three types (S, G, and D) are disposed in a specific arrangement. In an upper array, the contacts are arranged in the order of S, S, S, S, D, D from the right side. In a middle array, the contacts are arranged in the order of G, G, G, G, D, D from the right side. In a lower array, the contacts are arranged in the order of S, S, S, S, D from the right side. The signal contacts S, S adjacent to each other in the upper array and the ground contact G in the middle array are located at three apexes of an isosceles triangle. Likewise, the ground contact G in the middle array and the signal contacts S, S adjacent to each other in the lower array are located at three apexes of an isosceles triangle.

Figure 5A:
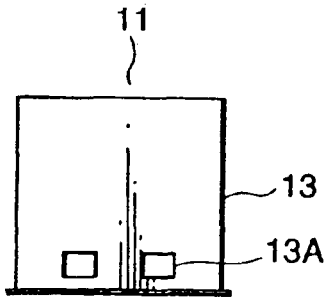
FIG. 5A is a plan view of the receptacle connector illustrated in FIG. 4.
Figure 5C:
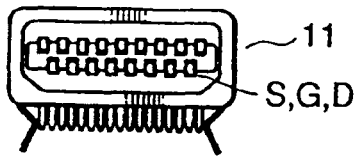
FIG. 5C is a front view of the receptacle connector of FIG. 5A.
Figure 5B:
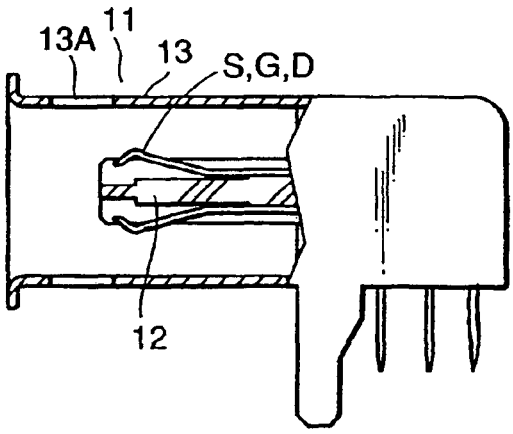
FIG. 5B is a partially-sectional side view of the receptacle connector of FIG. 5A.
Figure 5D:
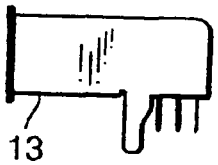
FIG. 5D is a side view of the receptacle connector of FIG. 5A.

As illustrated in FIGS. 4, 5A, and 5B, the receptacle shell 13 has an upper surface provided with a pair of holes 13A. The holes 13A are adapted to be engaged with a plug connector 16 illustrated in FIGS. 6A to 6C.

Figure 6A:
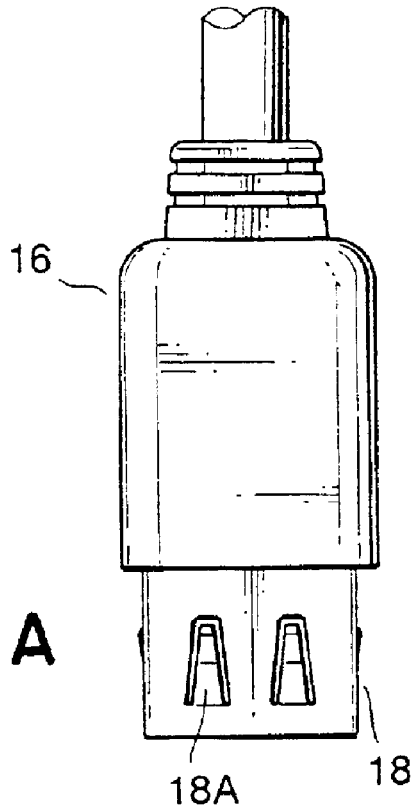
FIG. 6A is a plan view of a plug connector adapted to be connected to the receptacle connector illustrated in FIGS. 5A to 5D.
Figure 6C:
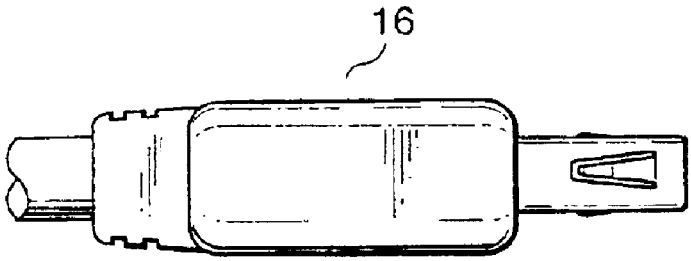
FIG. 6C is a side view of the plug connector of FIG. 6A.
Figure 6B:
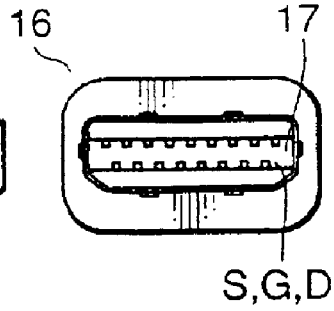
FIG. 6B is a front view of the plug connector of FIG. 6A.

Referring to FIGS. 6A to 6C, the plug connector 16 comprises a plurality of signal contacts S, a plurality of ground contacts G, a plurality or ordinary contacts D, an insulator 17 holding the signal contacts S, the ground contacts G, and the ordinary contacts D, and a plug shell 18 surrounding all of the above-mentioned components.

The plug shell 18 has an upper surface provided with a pair of springs 18A. The springs 18A are adapted to be engaged with the holes 13A of the receptacle connector 11, respectively.

Next referring to FIGS. 7A, 7B, and 8A to 8D, description will be made of a connector according to a third embodiment of this invention.

The connector illustrated in the figures is a receptacle connector 21 of a SMT (Surface Mount) type. As illustrated in FIGS. 7B and 8A to 8D, the receptacle connector 21 comprises a plurality of signal contacts S, a plurality of ground contacts G, a plurality of ordinary contacts D, an insulator 22 holding the signal contacts S, the ground contacts G, and the ordinary contact D, and a receptacle shell 23 surrounding all of the above-mentioned components.

Figure 7A:
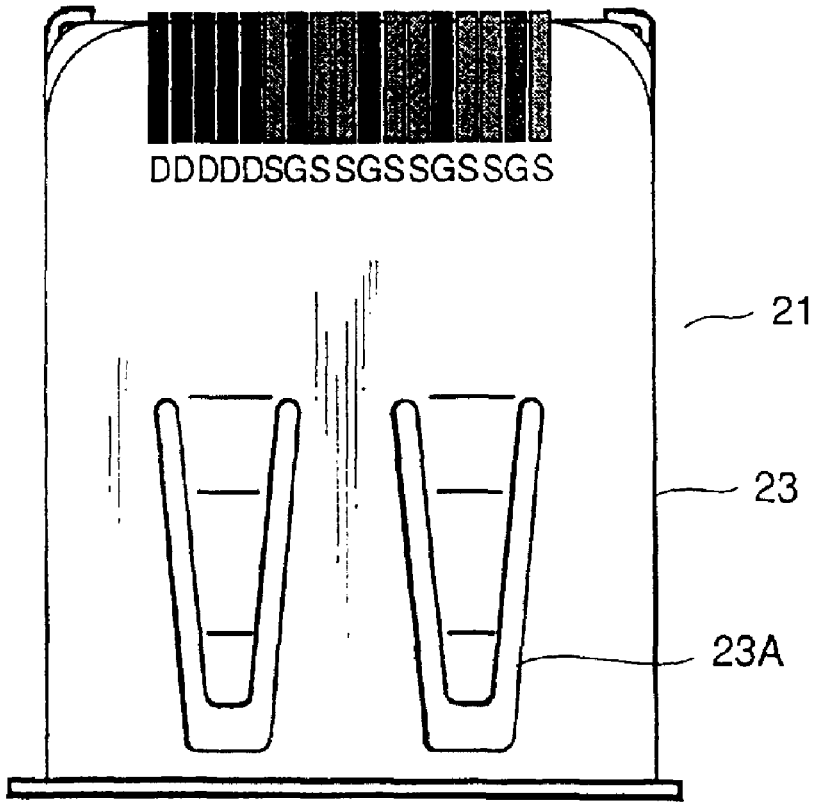
FIG. 7A is a schematic plan view of a receptacle connector according to a third embodiment of this invention.
Figure 7B:
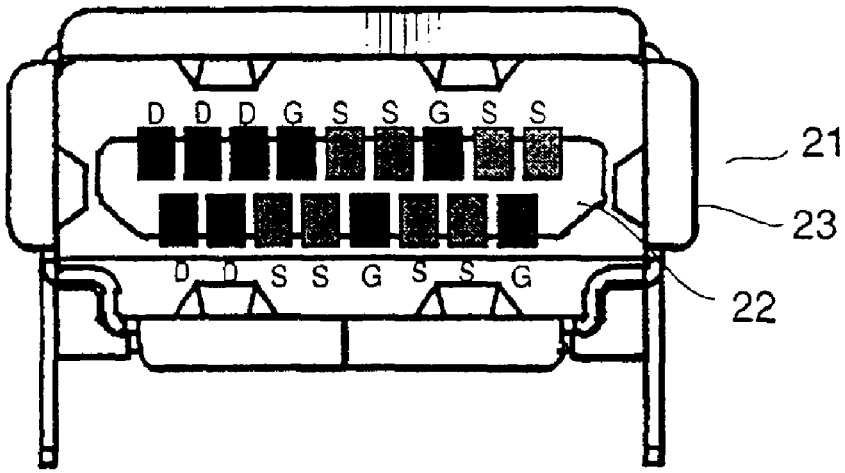
FIG. 7B is a schematic front view of the receptacle connector of FIG. 7A.

As illustrated in FIG. 7B, the contacts of the above-mentioned three types (S, G, and D) are disposed in a specific arrangement. In an upper array, the contacts are arranged in the order of S, S, G, S, S, G, D, D, D from the right side. In a lower array, the contacts are arranged in the order of G, S, S, G, S, S, D, D from the right side. The signal contacts S, S adjacent to each other in the upper array and the ground contact G in the lower array are located at three apexes of an isosceles triangle. Likewise, the ground contact G in the upper array and the signal contacts S, S adjacent to each other in the lower array are located at three apexes of an isosceles triangle.

As illustrated in FIG. 7A, the contacts are arranged in a single line in the order of S, G, S, S, G, S, S, G, S, S, G, S, D, D, D, D, D form the right side and exposed from the receptacle shell 23.

Figure 8A:
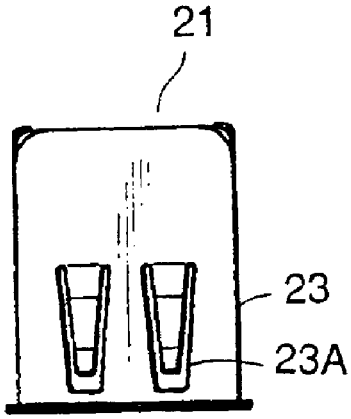
FIG. 8A is a plan view of the receptacle connector illustrated in FIGS. 7A and 7B.
Figure 8B:
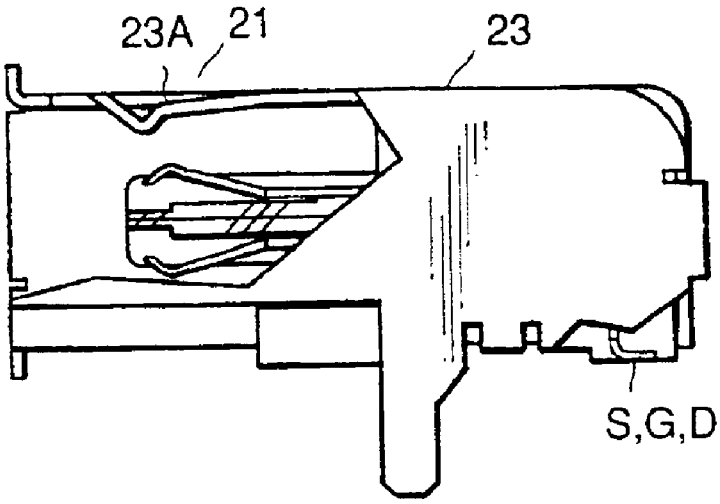
FIG. 8B is a partially-sectional side view of the receptacle connector of FIG. 8A.
Figure 8C:
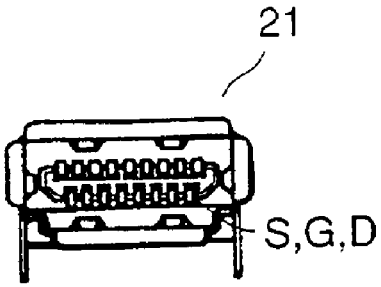
FIG. 8C is a front view of the receptacle connector of FIG. 8A.
Figure 8D:
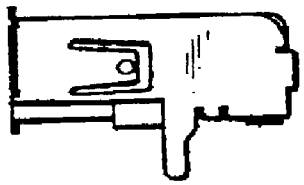
FIG. 8D is a side view of the receptacle connector of FIG. 8A.

As illustrated in FIGS. 7A, 8A, and 8B, the receptacle shell 23 has an upper surface provided with a pair of springs 23A. The springs 23A are adapted to be engaged with a plug connector (not shown).

Referring to FIGS. 9 through 11A and 11B, description will be made of a connection structure of the connector in each embodiment and transmission cables.

Figure 9:
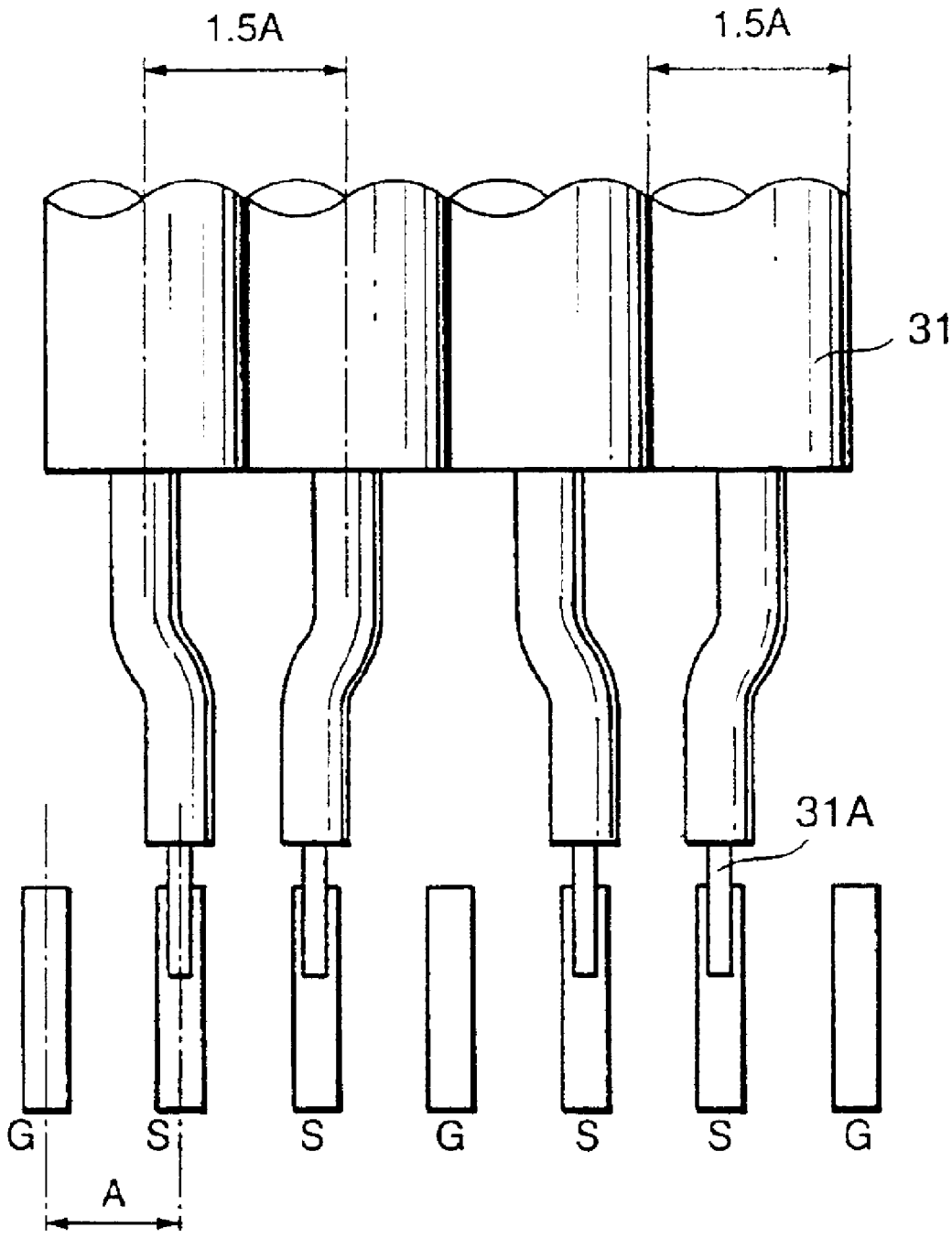
FIG. 9 is a plan view for describing a connection pattern of transmission cables.

As illustrated in FIG. 9, each transmission cable 31 has a center conductor 31A connected to each signal contact S. Each of the signal contacts S and the ground contacts G has a terminal portion to be connected to a printed board. The terminal portions are arranged in a single line in a manner such that two signal contacts S are arranged adjacent to each other and one ground contact G is arranged next. The signal contacts S and the ground contacts G are arranged at a predetermined pitch A. In this structure, a space is left in an area faced to each ground contact G. By utilizing the space, it is possible to arrange the transmission cables 31, each of which has a diameter greater than A and smaller than 1.5A, with the center conductors 31A of the transmission cable 31 connected to the signal contacts S.

In each of the above-mentioned connectors, the plug connector with the transmission cables connected thereto is fitted to the receptacle connector mounted to the printed board. Each of the signal contacts S, the ground contacts G, and the ordinary contact D may be of a surface-mount type or a through-hole type.

Figure 10C:
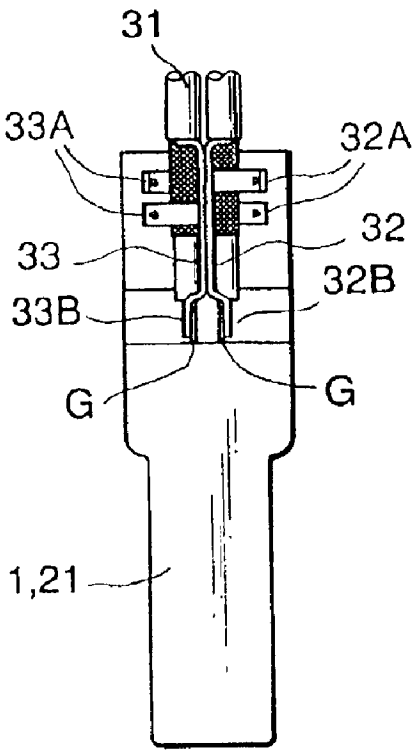
FIG. 10C is a left side view of the connection structure of FIG. 10A.
Figure 10B:
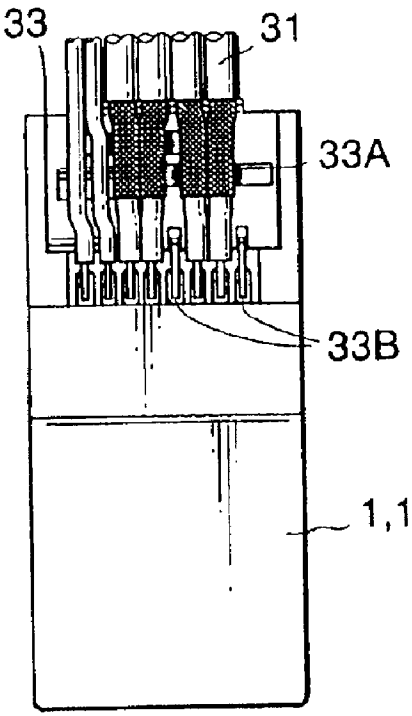
FIG. 10B is a bottom view of the connection structure of FIG. 10A.
Figure 10A:
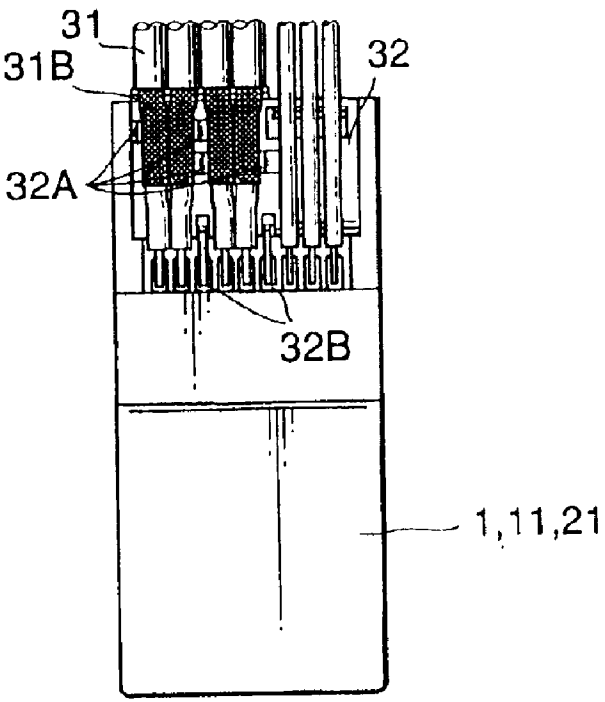
FIG. 10A is a plan view of a connection structure between the transmission cables and each of the receptacle connectors.

Referring to FIGS. 10A to 10C, the transmission cables 31 have shield portions 31B divided into upper and lower arrays. Upper-array and lower-array ground plates 32 and 33 are superposed to each other and inserted between the upper and the lower arrays of the shield portions 31B. The upper-array ground plate 32 has connecting portions 32A connected to the shield portions 31B of the upper array. The lower-array ground plate 33 has connecting portions 33A connected to the shield portions 31B of the lower array.

The upper-array and the lower-array ground plates 32 and 33 are provided with lead portions 32B and 33B to be contacted with or soldered to the ground contacts G, respectively. The upper-array and the lower-array ground plates 32 and 33 are faced to each other with the lead portions 32B and 33B alternately arranged. In this manner, the lead portions 32B and 33B can be connected to the ground contacts G arranged in a staggered fashion and located at the apexes of the isosceles triangles.

As illustrated in FIG. 10B, the lead portions 33B of the lower-array ground plate 33 are connected to the ground contacts G of the upper array while the lead portions 32B of the upper-array ground plate 32 are connected to the ground contacts G of the lower array. Alternatively, as illustrated in FIG. 10C, the lead portions 32B of the upper-array ground plate 32 are connected to the ground contacts G of the upper array while the lead portions 33B of the lower-array ground plate 33 are connected to the ground contacts G of the lower array.

Figure 11A:
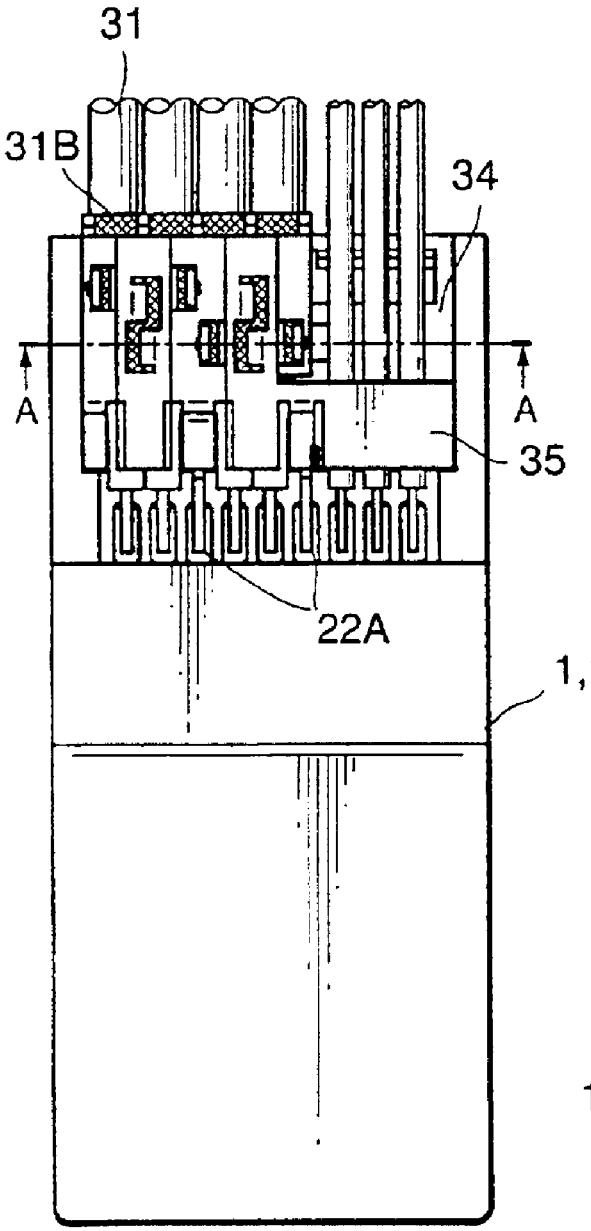
FIG. 11A is a plan view of a modification of the connection structure illustrated in FIGS. 10A to 10C.
Figure 11B:
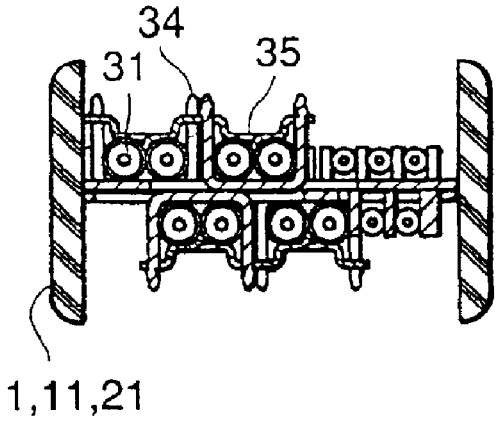
FIG. 11B is a sectional view taken along a line A—A in FIG. 11A.
Figures 12A, 12B, 12C, 12D:
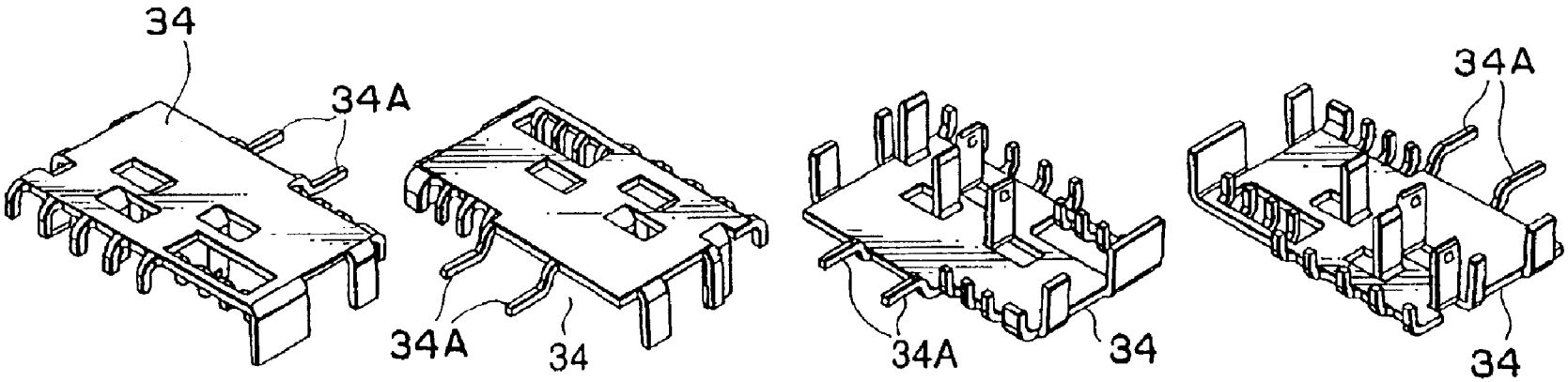
FIGS. 12A to 12J are various views each showing a ground plate used in each of the receptacle connectors.
Figure 12J:
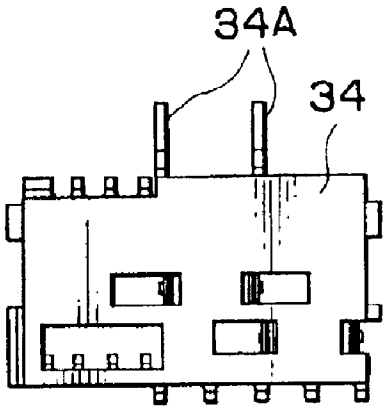
Figure 12I:
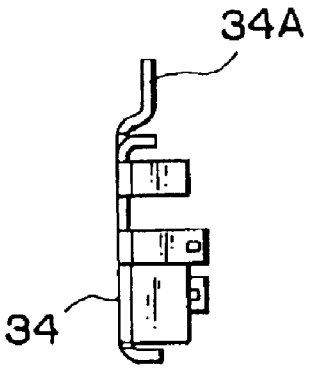
Figure 12F:
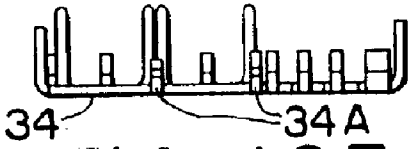
Figure 12E:
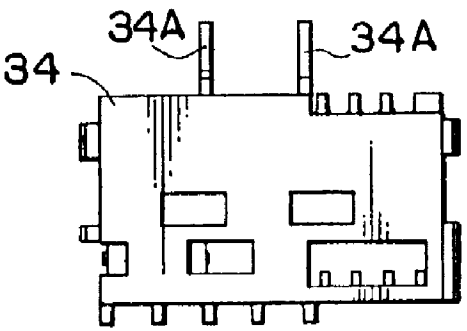
Figure 12G:
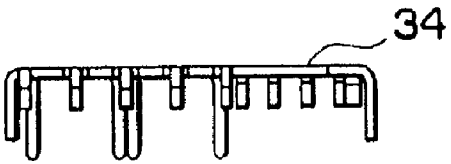
Figure 12H:
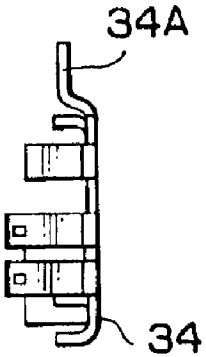
Figure 13A:
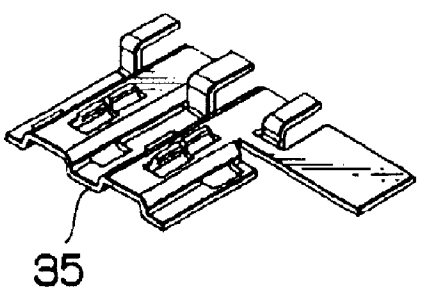
FIGS. 13A to 13J are various views each showing a shield plate used in each of the receptacle connectors.
Figure 13B:
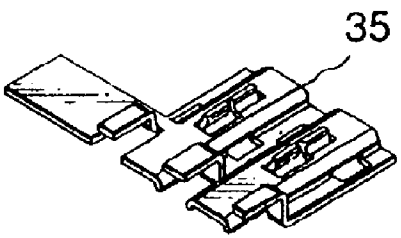
Figure 13C:
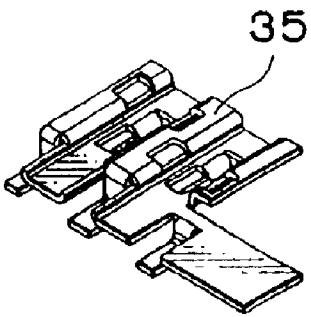
Figure 13D:
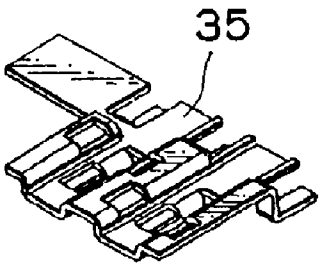
Figure 13J:
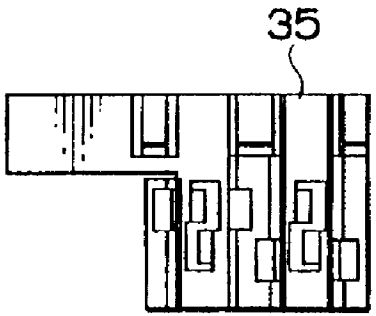
Figure 13I:
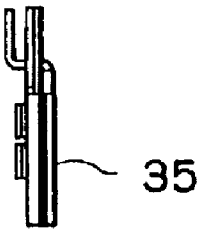
Figure 13F:
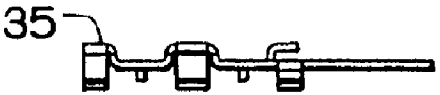
Figure 13E:
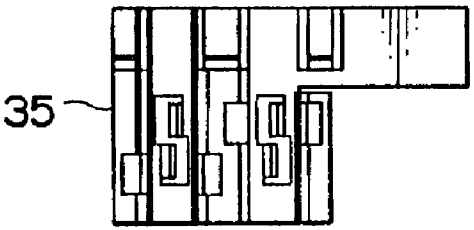
Figure 13G:
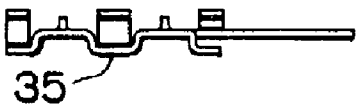
Figure 13H:
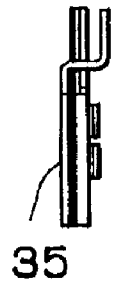
Figure 14A:
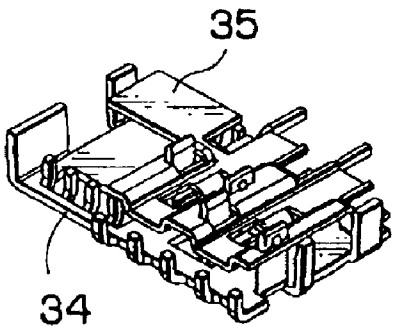
FIGS. 14A to 14J are various views each showing a combination of the ground plate and the shield plate engaged with each other.
Figure 14B:
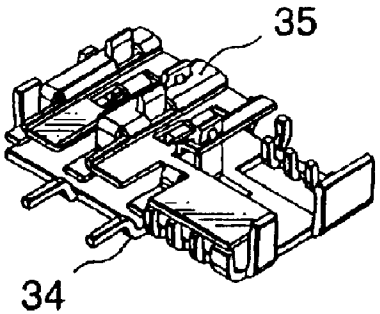
Figure 14C:
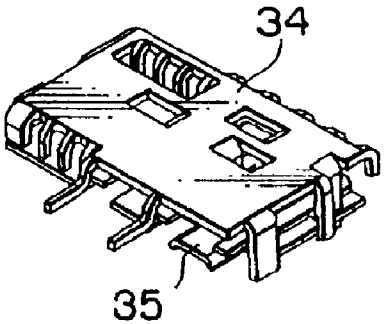
Figure 14D:
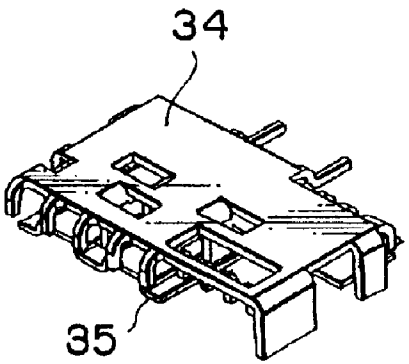
Figure 14F:
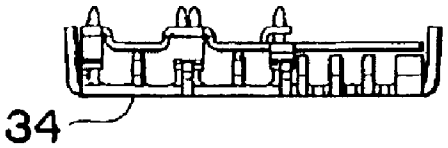
Figure 14E:
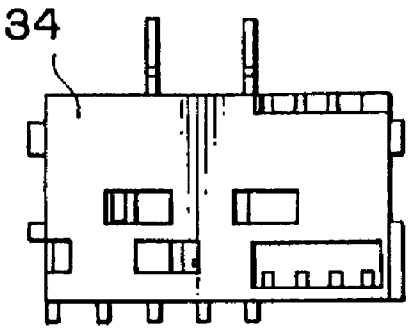
Figure 14G:
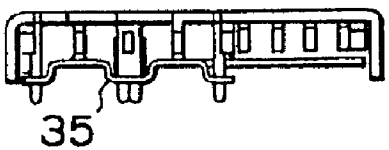
Figure 14H:
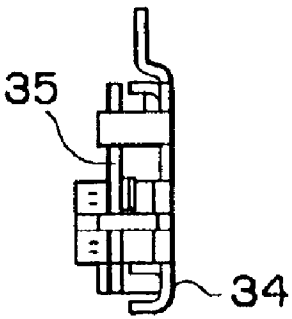
Figure 14I:
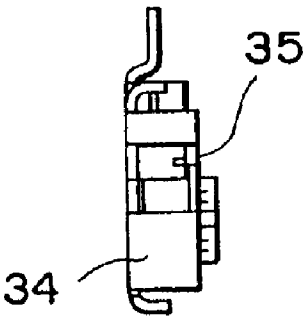
Figure 14J:
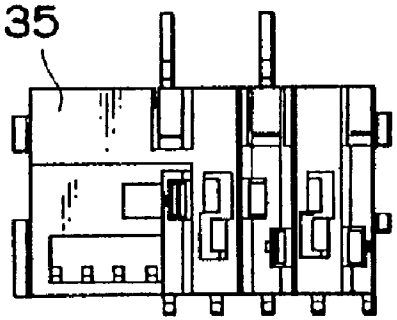

As illustrated in FIGS. 11A and 11B, the shield portion 31B of each of the transmission cables 31 on both upper and lower sides may be surrounded by a ground plate 34 on the left, right, and lower sides and by a shield plate 35 on an upper side. In this event, the shield portion 31B of the transmission cable 31 is connected to the ground plate 34 and the shield plate 35.

Referring to FIGS. 12A to 12J, the ground plate 34 of the connector is illustrated as seen in different directions. The ground plate 34 has one side provided with a pair of lead portions 34A which can be connected to an electric circuit formed on the circuit board.

Referring to FIGS. 13A to 13J, the shield plate 35 of the connector is illustrated as seen in different directions. The shield plate 35 is engaged with the ground plate 34 to form a combination of the ground plate and the shield plate, as illustrated in FIGS. 14A to 14J.

Figure 15:
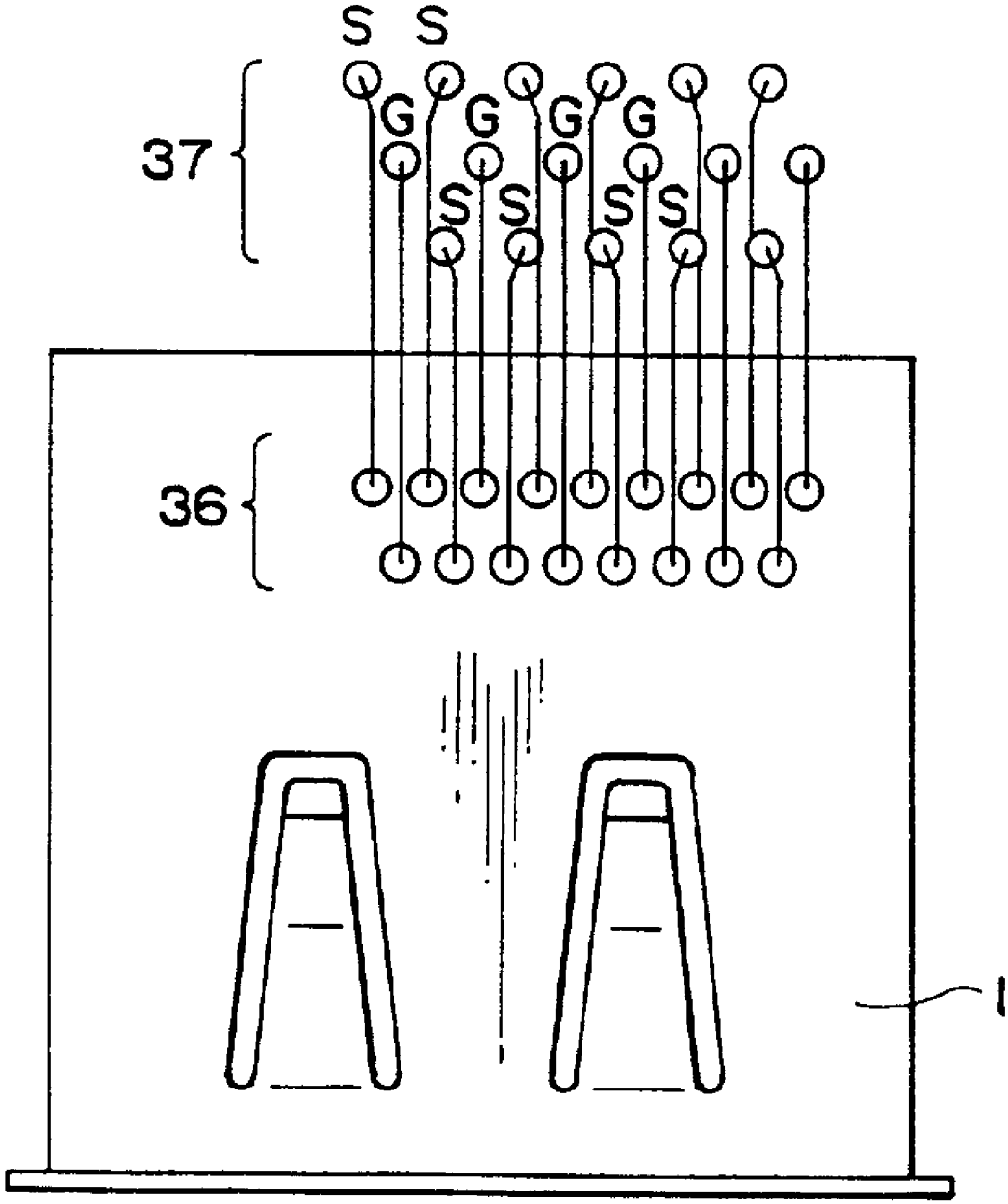
FIG. 15 is a view for describing pitch conversion between contacts and through holes which are formed in a circuit board for receiving the contacts, respectively.

Referring to FIG. 15, the description will be made as regard a pitch of contacts 36 provided on the receptacle connector 1.

The contacts 36 are arranged in two rows on the receptacle connector 1. In this condition, the pitch is relatively small or narrow on the receptacle connector 1. The contacts 36 may be connected to an electric circuit of the circuit board by inserting the contacts 36 in through holes 37 formed in the circuit board. In this event, the through holes 37 can be arranged in three or more rows. In case where the through holes 37 are arranged in three or more rows, it becomes possible to make the pitch of the through holes 37 be relatively large or widen the pitch on the circuit board. This results in pitch conversion between the contacts 36 and the through holes 37.

What is claimed is:

1. A connector having a first end for fitting to another connector and second end for connecting to a board, comprising:

an insulator;

plural contacts held by said insulator, said contacts being arranged at said first end in two rows to make a staggered fashion between said two rows and arranged at said second end in three rows to make a staggered fashion between adjacent ones of said three rows, said contacts comprising plural signal contacts and plural ground contacts, each of said ground contacts having a single contact portion at said first end, said first end having plural contact sets in each of which two of said signal contacts and said single contact portion of one of said ground contacts are located at three apexes of an isosceles triangle at said first end, respectively, said signal contacts being arrayed on each of outer ones of said three rows at said second end, said ground contacts being arrayed on a middle one of said three rows at said second end, two of said signal contacts on one of said outer ones of the three rows and one of said ground contacts on said middle one of the three rows making one of said contact sets and being located at three apexes of an isosceles triangle at said second end, respectively, a plurality of + signal contacts; and a plurality of − signal contacts;

said contacts being arranged in a manner such that a set of each single one of said + signal contacts, each single one of said − signal contacts, and each single one of said ground contacts are located at three apexes of an isosceles triangle, respectively, wherein said + signal contacts, said − signal contacts, and said ground contacts are arranged at a predetermined pitch, a plurality of transmission cables being connected to one of said + signal contact and said − signal contact.

2. The connector according to claim 1, wherein a plurality of said isosceles triangles are defined, bottom sides of said isosceles triangles being alternately arranged in a staggered fashion.

3. The connector according to claim 1, further including a printed board provided with through-holes formed in three arrays at positions where said + signal contacts, said − signal contacts, and said ground contacts are mounted, said ground contacts being arranged in said through holes in the middle array.

4. The connector according to claim 1, said connector being for use in high-speed differential signal transmission according to the TMDS standard.

5. The connector according to claim 1, further including a printed board on which said + signal contacts, said − signal contacts, and said ground contacts are arranged in a single array and surface-mounted.

6. The connector according to claim 1, wherein said ground contact is arranged between said + signal contact and said − signal contact.

7. The connector according to claim 1, wherein one of said plurality of transmission cables is one of a twisted shield cable and a coaxial cable.

8. The connector according to claim 7, wherein said one of said plurality of transmission cables is a twisted shield cable, said connector comprising an upper-array ground plate and a lower-array ground plate each of which is connected to a shield portion of said twisted shield cable, each of said upper-array and lower-array ground plates having lead portions to be contacted with or soldered to said ground contacts, said upper-array and said lower-array ground plates being faced to each other, said lead portions being alternately arranged and connected to said ground contacts located at the apexes of said isosceles triangles.

9. The connector according to claim 8, wherein said shield portion of said twisted shield cable is surrounded by said ground plate on left, right, and lower sides and by said shield plate on an upper side.

* * * * *